US005544513A

United States Patent [19]

Pehle

[11] Patent Number: 5,544,513

[45] Date of Patent: Aug. 13, 1996

[54] METHOD FOR CONTROLLING THE STRETCHING OF ROLLING STOCK

[75] Inventor: Hans J. Pehle, Jüchen, Germany

[73] Assignee: Mannesmann Aktiengeselschaft, Düsseldorf, Germany

[21] Appl. No.: 162,637

[22] Filed: Dec. 3, 1993

[30] Foreign Application Priority Data

Dec. 3, 1992 [DE] Germany ..... 42 41 188.2

[51] Int. Cl.[6] ..... B21B 37/10

[52] U.S. Cl. ..... 72/12.2

[58] Field of Search ..... 72/8–13, 200, 72/367, 368; 364/557; 374/163, 183, 185

[56] References Cited

U.S. PATENT DOCUMENTS

| | | | |
|---|---|---|---|
| 2,084,332 | 6/1937 | Findlater | 72/13 |
| 3,312,092 | 4/1967 | Newmann | 72/13 |
| 3,606,778 | 9/1971 | Bomberger | 72/13 |
| 5,047,964 | 9/1991 | Lalli | 72/13 |

FOREIGN PATENT DOCUMENTS

| | | | |
|---|---|---|---|
| 2209126 | 1/1973 | Germany | 72/12 |
| 52-43782 | 11/1977 | Japan | 72/13 |

*Primary Examiner*—Lowell A. Larson
*Assistant Examiner*—Thomas C. Schoeffler
*Attorney, Agent, or Firm*—Cohen, Pontani, Lieberman, Pavane

[57] ABSTRACT

A method for controlling the stretching of rolling stock, particularly of pipes, by way of a pilot control system for the rolling stock taking into consideration measured physical values of the rolling stock. In order to be able to adjust the pilot control system as accurately as possible, in addition to or instead of an optical temperature measurement, the temperature in the interior of the rolling stock is determined by an integral measurement of a physical quantity proportional to this temperature and is superimposed as a signal on the pilot control system.

4 Claims, No Drawings

METHOD FOR CONTROLLING THE STRETCHING OF ROLLING STOCK

BACKGROUND OF THE INVENTION

1. Field of Invention

The invention relates to a method for controlling the stretching of rolling stock, particularly of pipes, by way of a pilot control system for the rolling mill, taking into consideration the measured physical values of the rolling stock.

2. Description of the Prior Art

The primary objective of using measurement and control techniques in rolling mill installations is to increase the dimensional accuracy and quality of rolling mill products. The flexibility of a production plant can also be increased by automation measures, in order to manufacture small lot sizes of rolled products economically. The control system generally consists of a pilot control system, by means of which the reshaping of the rolling stock is planned in advance, and a control component, which consists of a feedback of measurement data of the rolling stock in order to adjust just the rolling mill. In comparison with the control system, the pilot control system is adjusted more quickly and, in principle, controls the process more extensively.

If it is possible to make the pilot control system as accurate as possible and to determine the actuating variables as extensively as possible, then the first product of the series of a rolling milling production can already be produced with the high dimensional accuracy that is required. Variations in the actuating variables, such as in the dimensional changes in the initial product and in the temperature losses, can be timely detected and compensated for by means of a pilot control system of the rolling mill.

It is well known that the dimensional accuracy of the rolling stock can be prejudiced by its properties, particularly by its dimensions, by the composition of its material and by its temperature. The dimensions of the initial product can be determined by measurement, for example, with the help of isotope or eddy current measurement methods. These methods can be used with sufficient accuracy. The material composition usually is known from the production planning by following the material.

Radiation pyrometers, with which the temperature of the surface of the rolling stock can be determined optically, are usually used to measure the temperature of the rolling stock. Frequently, however, the temperature measurement data is not suitable for use in the control systems, since such data can deviate considerably in magnitude as well as in trend from the effective average temperature of the rolling stock. For control systems, however, only one measured value can be taken as suitable. This measured value must represent the average temperature in the cross section of the rolling stock since only this parameter permits determination of the change in the flow behavior of the material.

The process-induced effects, which call cause errors when a radiation pyrometer is used and distort the result of the measurement, are cinder particles or an inhomogeneous temperature distribution in the cross section of the rolling stock.

Different temperature gradients, even temperature gradients of unknown algebraic sign, can arise in the material depending on the prior history of the rolling stock (heating, re-shaping, cooling). The heat is introduced into the rolling stock and is dissipated once again over the surface, so that especially here a particularly high temperature gradient can arise.

It follows from all the foregoing that considerable errors must necessarily arise if the average temperature in the cross section, which alone has a determining effect on the stretching of the rolling stock, is estimated from the surface temperature. This is particularly serious because a wrong value, used in the pilot control system, can lead to larger errors than a nominal value.

SUMMARY AND DESCRIPTION OF THE INVENTION

Starting out from problems and disadvantages of the state of the art that have been described, it is all object of the present invention to provide a method with which the pilot control system call be adjusted with the highest accuracy possible for controlling the stretching of rolling stock.

Pursuant to this object, and others which will become apparent hereafter, one aspect of the present invention resides in determining, in addition to or instead of the optical measurement of the temperature, the temperature in the interior of the rolling stock by means of an integral measurement of a physical quantity proportional to this temperature and superimposing it as a signal on the pilot control.

If the temperature of the interior of the rolling stock call be determined in this manner, then it is possible to undertake a suitable pilot control of the rolling mill with this measured value, which represents the average temperature of the rolling stock, without distorted measured values being entered into the control system. Cinders in the surface of the rolling stock and any inhomogeneous temperature distribution can be disregarded in this method, since the temperature, which is important for the deformation of the rolling stock and for its flow behavior, is always the one which is determined.

Preferably, the electrical conductivity of the rolling stock is measured as the physical quantity, which is proportional to the temperature in the interior of the rolling stock. The temperature of the rolling stock can be deduced from this value.

According to a further embodiment of the invention, the dependence of the conductivity of the temperature on the composition of the respective rolling stock can be determined in the laboratory and deposited in the process computer of the control system. It is, however, also possible to determine the dependence of the conductivity on the temperature and the composition of the material at the same time that the temperature is measured in the rolling operation.

With the present invention, constant product dimensions can be achieved even at different temperatures and with different plastic properties of the rolling stock. The rolled products can be produced with distinctly higher dimensional accuracies, because the pilot control system of the rolling mill is significantly more accurate.

The invention is not limited by the embodiments described above which are presented as examples only but can be modified in various ways within the scope of protection defined by the appended patent claims.

What is claimed is:

1. A method for controlling stretching of pipe rolling stock with a pilot control system for a pipe rolling mill, comprising the steps of: determining temperature in an interior region of the rolling stock prior to rolling by integrally measuring a physical quantity of the pipe rolling stock other than surface temperature proportional to the temperature in the interior region; and superimposing the temperature as a signal on the pilot control system.

2. A method according to claim 1, including measuring electrical conductivity of the rolling stock as the physical quantity which is proportional to the temperature in the interior region of the rolling stock.

3. A method according to claim 2, including determining data regarding a dependence of the conductivity on a composition of a respective rolling stock material in a laboratory, and depositing the data in a process computer of the control system.

4. A method according to claim 1, including optically measuring temperature of the rolling stock.

* * * * *